US011852145B2

(12) United States Patent
Johnson et al.

(10) Patent No.: US 11,852,145 B2
(45) Date of Patent: Dec. 26, 2023

(54) ROTARY COMPRESSORS WITH VARIABLE SPEED AND VOLUME CONTROL

(71) Applicant: Trane International Inc., Davidson, NC (US)

(72) Inventors: Jay H. Johnson, Houston, MN (US); John R. Sauls, La Crosse, WI (US); Gordon Powell, Stoddard, WI (US); Daniel R. Crum, Huntersville, NC (US)

(73) Assignee: Trane International, Inc., Davidson, NC (US)

( * ) Notice: Subject to any disclaimer, the term of this patent is extended or adjusted under 35 U.S.C. 154(b) by 937 days.

(21) Appl. No.: 16/728,570

(22) Filed: Dec. 27, 2019

(65) Prior Publication Data

US 2020/0132074 A1 Apr. 30, 2020

Related U.S. Application Data

(62) Division of application No. 14/504,182, filed on Oct. 1, 2014, now Pat. No. 10,533,556.

(Continued)

(51) Int. Cl.
*F04C 29/12* (2006.01)
*F04C 28/14* (2006.01)

(Continued)

(52) U.S. Cl.
CPC ..... *F04C 29/124* (2013.01); *F04C 18/16* (2013.01); *F04C 28/08* (2013.01); *F04C 28/12* (2013.01);

(Continued)

(58) Field of Classification Search
CPC ..... F04C 29/124; F04C 18/16; F04C 28/08; F04C 28/12; F04C 28/14; F04C 28/24;

(Continued)

(56) References Cited

U.S. PATENT DOCUMENTS 4,042,310 A 8/1977 Schibbye et al.
4,351,160 A * 9/1982 Kountz ..... F04C 28/08 62/203

(Continued)

FOREIGN PATENT DOCUMENTS

DE 3021419 A1 2/1981
DE 3218060 A1 12/1982

(Continued)

OTHER PUBLICATIONS

Patent Cooperation Treay, Search Report and Written Opinion in corresponding application No. PCT/US2014/058669, dated Jan. 7, 2015, 11 pp.

(Continued)

*Primary Examiner* — Dominick L Plakkoottam
(74) *Attorney, Agent, or Firm* — Taft Stettinius & Hollister LLP

(57) ABSTRACT

Systems and methods are used to control operation of a rotary compressor of a refrigeration system to improve efficiency by varying the volume ratio and the speed of the compressor in response to current operating and load conditions. The volume of the axial and/or radial discharge ports of the compressor can be varied to provide a volume ratio corresponding to operating conditions. In addition, permanent magnet motors and/or control of rotor tip speed can be employed for further efficiency gains.

19 Claims, 8 Drawing Sheets

Related U.S. Application Data

(60) Provisional application No. 61/885,174, filed on Oct. 1, 2013.

(51) Int. Cl.

| | |
|---|---|
| ***F04C 28/12*** | (2006.01) |
| ***F04C 28/28*** | (2006.01) |
| ***F04C 28/24*** | (2006.01) |
| ***F04C 28/08*** | (2006.01) |
| ***F04C 18/16*** | (2006.01) |
| ***F25B 1/047*** | (2006.01) |
| ***F25B 49/02*** | (2006.01) |

(52) U.S. Cl.
CPC ..... *F04C 28/14* (2013.01); *F04C 28/24* (2013.01); *F04C 28/28* (2013.01); *F25B 1/047* (2013.01); *F25B 49/022* (2013.01); *F04C 2240/403* (2013.01); *F04C 2240/81* (2013.01); *F04C 2270/025* (2013.01); *F04C 2270/585* (2013.01); *F25B 2600/0253* (2013.01)

(58) Field of Classification Search
CPC ..... F04C 28/28; F04C 2240/403; F04C 2240/81; F04C 2270/025; F04C 2270/585; F25B 1/047; F25B 49/022; F25B 2600/0253; F25B 2600/02
See application file for complete search history.

(56) References Cited

U.S. PATENT DOCUMENTS

| | | | | |
|---|---|---|---|---|
| 4,727,725 | A | 3/1988 | Nagata et al. | |
| 4,946,362 | A | 8/1990 | Soderlund et al. | |
| 5,509,273 | A | 4/1996 | Lakowske et al. | |
| 5,806,327 | A | 9/1998 | Lord et al. | |
| 6,659,729 | B2 * | 12/2003 | Hattori | F04C 28/125 417/282 |
| 7,332,885 | B2 | 2/2008 | Schnetzka et al. | |
| 8,287,248 | B2 | 10/2012 | Pills et al. | |
| 2002/0001523 | A1 | 1/2002 | Tsuru et al. | |
| 2002/0113201 | A1 * | 8/2002 | McAllister | G01D 5/34738 250/231.13 |
| 2003/0215336 | A1 * | 11/2003 | Hattori | F04C 28/12 417/299 |
| 2006/0008375 | A1 | 1/2006 | Hasegawa | |
| 2006/0039805 | A1 * | 2/2006 | Gotou | F04C 28/12 417/410.4 |
| 2006/0104846 | A1 | 5/2006 | Hwang | |
| 2007/0151269 | A1 | 7/2007 | Crane et al. | |
| 2010/0247361 | A1 | 9/2010 | Nemit, Jr. et al. | |
| 2011/0192188 | A1 | 8/2011 | Nickey et al. | |
| 2012/0017634 | A1 | 1/2012 | Dorman et al. | |
| 2012/0027632 | A1 * | 2/2012 | Nemit, Jr. | F04C 28/125 417/440 |
| 2012/0078424 | A1 | 3/2012 | Raghavachari | |
| 2013/0216414 | A1 * | 8/2013 | Kopko | F04C 18/16 418/201.2 |
| 2014/0127067 | A1 * | 5/2014 | Kienzle | F04C 2/16 418/83 |
| 2014/0260414 | A1 * | 9/2014 | Nemit, Jr. | F04C 28/12 62/498 |
| 2015/0000315 | A1 * | 1/2015 | Blumhardt | F25B 49/022 62/126 |
| 2018/0017060 | A1 * | 1/2018 | Nemit, Jr. | F04C 28/26 |
| 2020/0132074 | A1 * | 4/2020 | Johnson | F04C 18/16 |

FOREIGN PATENT DOCUMENTS

| | | | | |
|---|---|---|---|---|
| GB | 2282642 | A | 4/1995 | |
| JP | H09317676 | A * | 12/1997 | F04C 28/12 |
| WO | 2008112568 | A2 | 9/2008 | |
| WO | 2011048618 | A1 | 4/2011 | |
| WO | 2012037229 | A1 | 3/2012 | |
| WO | 2012041259 | A1 | 4/2012 | |

OTHER PUBLICATIONS

J. Cosner, "Improving Rotary Screw Compressor Performance using Variable Speed Drives," Johnson Controls Presentation, dated May 2009, 37 pp.

Carrier, "Variable Speed Screw Compressor—Raising The Bar For Variable Speed Performance," dated Oct. 2005, 7 pp., Carrier Corporation, Syracuse, NY.

German Patent and Trademark Office, Examination Report in corresponding application No. 11 2014 004 177.7, dated Jul. 6, 2018, 9 pp.

* cited by examiner

ROTARY COMPRESSORS WITH VARIABLE SPEED AND VOLUME CONTROL

CROSS REFERENCE TO RELATED APPLICATIONS

This application claims the benefit of U.S. Provisional Application No. 61/885,174, filed Oct. 1, 2013, and is a divisional application of U.S. Non-Provisional application Ser. No. 14/504,182, filed Oct. 1, 2014, which are both incorporated herein by reference in their entireties.

FIELD OF THE INVENTION

The present invention generally relates to rotary compressors, and more particularly, but not exclusively, to rotary compressors with variable speed control and variable volume ratio.

BACKGROUND

Compressors in refrigeration systems raise the pressure of a refrigerant from an evaporator pressure to a condenser pressure. The evaporator pressure is sometimes referred to as the suction pressure and the condenser pressure is sometimes referred to as the discharge pressure. Many types of compressors, including rotary screw-type compressors, are used in such refrigeration systems. Rotary screw compressors are positive displacement, volume reduction devices.

A rotary screw-type compressor includes a suction port and a discharge port that open into a working chamber of the compressor. The working chamber includes a pair of meshed male and female screw rotors in a compressor housing that define a compression pocket between the screw rotors and interior walls of the working chamber of the compressor housing. The working chamber of the compressor housing defines a volume shaped as a pair of parallel intersecting flat-ended cylinders, with the each rotor housed primarily in one of the cylindrical volumes.

In conventional operation of refrigeration-based systems, the counter-rotation of the intermeshing screw rotors draws a mass of refrigerant gas at suction pressure into the suction port from a suction area at the low pressure end of the compressor. The refrigerant is delivered through the suction port to a compression pocket having a chevron shape, sometimes called a flute space. The compression pocket is defined by the intermeshed rotors and the interior wall of the working chamber. As the intermeshing screw rotors rotate, the compression pocket is closed off from the suction port. Gas compression occurs as the compression pocket volume decreases as the intermeshing screw rotors rotate. The compression pocket is circumferentially and axially displaced to the high pressure discharge end of the compressor by the rotation of the intermeshing screw rotors and comes into communication with the discharge port. The compressed refrigerant gas is discharged radially and axially through the discharge port from the working chamber.

It is often desirable to operate such screw compressors at part-load conditions, such as when full capacity operation is not required. To improve performance at part-load conditions, several approaches have been employed. One approach that has been employed is the use of slide valve arrangements that control the amount of time the gas is compressed before release into the discharge port. Generally, the longer the gas is maintained in the compression pocket of the rotor, the higher the volume ratio of the inlet port to the outlet port. Slide valves allow the volume ratio to be changed based on conditions of the system, improving efficiency. However, interference of the slide valve with the rotors is desired to be avoided. As a result, complex arrangements have been developed to avoid such interference, which increase cost and maintenance of the compressor and limit the ability to control the compression ratio. Furthermore, when the capacity of the system is changing, changes in the volume ratio can result in diversion of gas back to the suction port of the compressor, causing suction gas heating and requiring re-compression of the diverted gas, reducing efficiencies.

Another approach that has been employed to improve part-load performance is the use of variable speed drives (VSDs). VSDs control motor loading by varying the speed that a motor drives the intermeshing screw rotors. VSDs typically vary the frequency and/or voltage provided to the motor. This frequency or voltage variance can allow the motor to provide a variable output speed and power in response to the load on the motor.

Employing VSDs in conventional screw compressors can cause reduced efficiency at full-load capacity. Another challenge with employing VSDs is that conventional motors reach their peak efficiency at their rated speed. As a result, motor efficiency drops at lower speeds. Such reduced theoretical performance compromises the energy savings level at part-load conditions.

Regardless of which approach is employed to achieve part-load performance, neither slide valve arrangements nor variable speed drives used independently in conventional screw compressors have resulted in variable capacity screw compressors that achieve desired efficiencies and operational control. Therefore, further improvements in methods and systems for operation of rotary compressors are desirable.

SUMMARY

Embodiments of refrigeration systems, compressor systems and methods to control rotary screw compressors of such systems to operate efficiently at varying load and operating conditions are disclosed. An embodiment of a method and system includes a rotary screw compressor of a refrigeration system that is operable to vary the volume ratio of the compressor by controlling at least one of the radial volume ratio and axial volume ratio of the discharge port in response to operating conditions of the system in conjunction with variable speed control of the motor driving the compressor rotors in response to load conditions. In one refinement, the compressor rotor speed is controlled by a permanent magnet motor connected to a variable speed drive. In a further refinement, the tip speed of the rotors is controlled for optimum efficiency. In yet another refinement, the radial and the axial volumes of the discharge port are varied to control the volume ratio of the compressor based on operating conditions. Further embodiments, forms, objects, features, advantages, aspects, and benefits shall become apparent from the following description and figures.

DETAILED DESCRIPTION

For the purposes of clearly, concisely and exactly describing exemplary embodiments of the invention, the manner and process of making and using the same, and to enable the practice, making and use of the same, reference will now be made to certain exemplary embodiments, including those illustrated in the figures, and specific language will be used to describe the same. It shall nevertheless be understood that no limitation of the scope of the invention is thereby created, and that the invention includes and protects such alterations, modifications, and further applications of the exemplary embodiments as would occur to one skilled in the art to which the invention relates.

Figure 1:
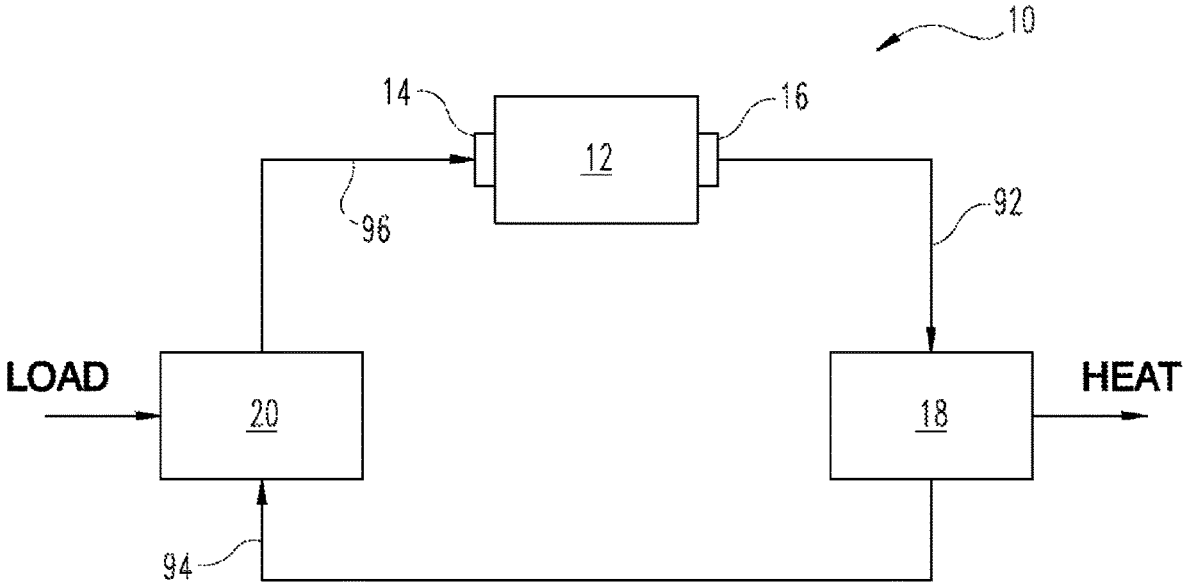
FIG. 1 shows an embodiment of a refrigeration system that includes a compressor system.

FIG. 1 depicts one embodiment of a refrigeration system 10. The refrigeration system 10 may circulate a fluid such as, for example, a refrigerant, as indicated by the arrows along plumbing connections 92, 94, 96 in order to receive a cooling load and remove the heat from the load for rejection elsewhere. As shown, the refrigeration system 10 includes a screw compressor system 12, a condenser system 18 coupled to the compressor system 12, and an evaporator system 20 coupled between the compressor system 12 and the condenser system 18. Screw compressor 12, condenser system 18, and evaporator system 20 are serially connected to form a closed loop refrigeration system 10. Other components and systems may also be provided with system 10, such as expansion valves, economizers, pumps, and the like as would be understood by those of ordinary skill in the art.

Refrigeration system 10 is directed to, for example, chillers systems in the range of about 20 to 500 tons or larger. Persons of ordinary skill in this art will readily understand that embodiments and features of this invention are contemplated to include and apply to, not only single stage compressors/chillers, but also to multiple stage compressors/chillers and single and/or multistage compressor/chillers operated in parallel.

Refrigeration system 10 may circulate a fluid to control the temperature in a space such as a room, home, or building, or for cooling of manufacturing processes or other suitable use. The fluid may be a refrigerant selected from an azeotrope, a zeotrope or a mixture or blend thereof in gas, liquid or multiple phases. For example, such refrigerants may be selected from: R-123, R-134a, R-1234yf, R-1234ze. R-410A, R-22 or R-32. Because embodiments of the present invention are not restricted to any particular refrigerant, the present invention is also adaptable to a wide variety of refrigerants that are emerging, such as low global warming potential (low-GWP) refrigerants.

The compressor system 12 may include a suction port 14 and a discharge port 16. As known to those skilled in the art, the suction port 14 of compressor system 12 receives the fluid in a first thermodynamic state, and the compressor system 12 compresses the fluid and transfers the fluid from the suction port 14 to the discharge port 16 at a higher discharge pressure and a higher discharge temperature. The fluid discharged from the discharge port 16 may be in a second thermodynamic state having a temperature and pressure at which the fluid may be readily condensed with cooling air or cooling liquid in condenser system 18.

The condenser system 18 receives the compressed fluid from discharge port 16 of the compressor system 12 and cools the compressed fluid as it passes through the condenser system 18. The condenser system 18 may include coils or tubes through which the compressed fluid passes and across which cool air or cool liquid flows to reject heat to the air or other medium. In one embodiment, condenser system 18 is a shell and tube flooded-type condenser, although other types of condensers are contemplated. The condenser system can be arranged as a single condenser or multiple condensers in series or parallel, e.g. connecting a separate or multiple condensers to each compressor.

Condenser system 18 may be configured to receive the fluid from discharge port 16 through plumbing 92. An oil separator (not shown) can be provided between compressor system 12 and condenser system 18. Condenser system 18 may transform the fluid from a superheated vapor to a saturated liquid. As a result of the cool air or cool liquid passing across the condenser tubing, the refrigerant fluid may reject or otherwise deliver heat from the refrigerant fluid to another fluid, like air or liquid, in a heat transfer relation, which in turn carries the heat out of the system 10.

The evaporator system 20 receives the cooled fluid from the condenser system 18 through plumbing 94 after passing through any intervening expansion valve and/or economizer and routes the cold fluid through coils or tubes of the evaporator system 20. Warm air or liquid providing a load is circulated from the space to be cooled across the coils or tubes of the evaporator system 20. The warm air or liquid passing across the coils or tubes of the evaporator system 20 causes a liquid portion of the cold fluid to evaporate. At the same time, the warm air or liquid passed across the coils or tubes may be cooled by the fluid, thus lowering the temperature of the space to be cooled. Compressor system 12 operates as a mechanical, suction type unloader for evaporator system 20. The evaporator system 20 then delivers the evaporated fluid to the suction port 14 of the compressor system 12 as a saturated vapor. The evaporator system 20 completes the refrigeration cycle and returns the fluid to the compressor system 12 to be recirculated again through the compressor system 12, condenser system 18, and evaporator system 20.

Evaporator system 20 can be, for example, a shell and tube flooded-type, but is not limited to such. The evaporator system 20 can be arranged as a single evaporator or multiple evaporators in series or parallel, such as by connecting a separate or multiple evaporators to each compressor. It should be understood that any configuration of the condenser system 18 and/or evaporator system may be employed that accomplishes the necessary phase changes of the fluid circulated through refrigeration system 10.

Figure 2:
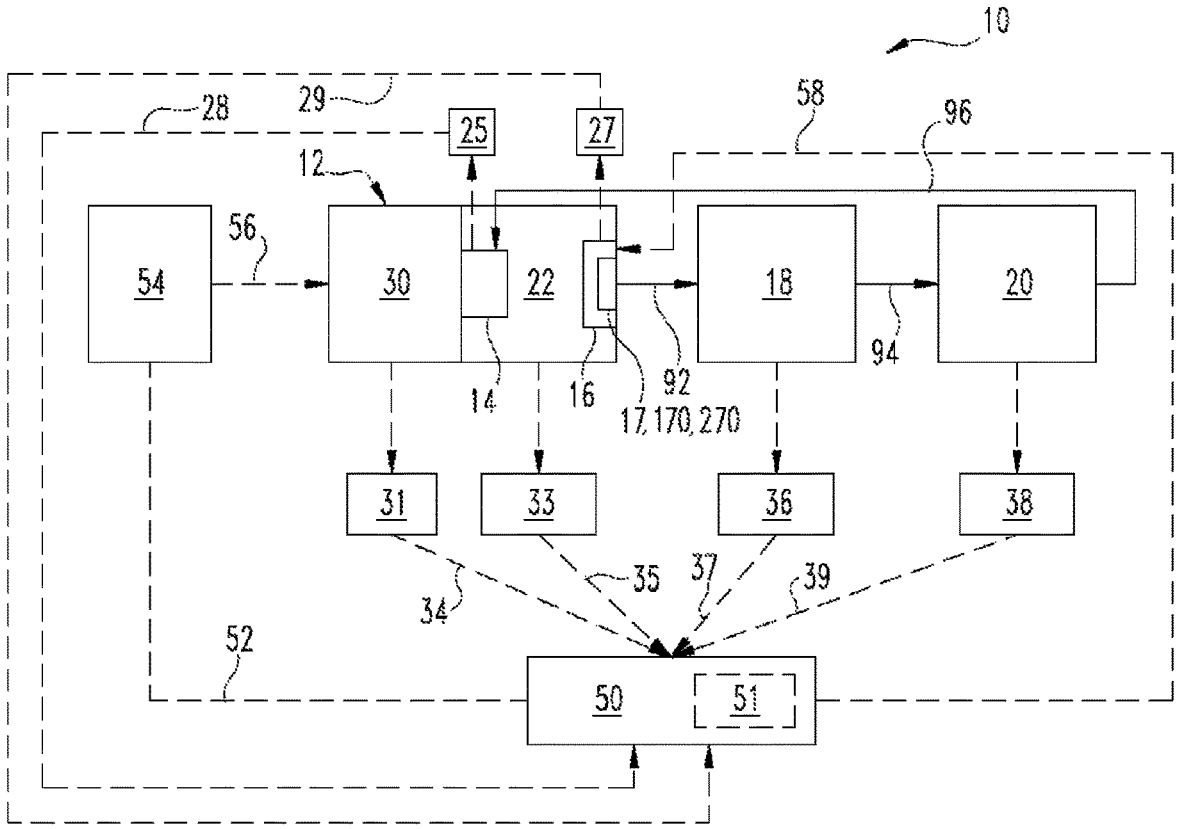
FIG. 2 shows the refrigeration system of FIG. 1 with a control system.
Figure 3:
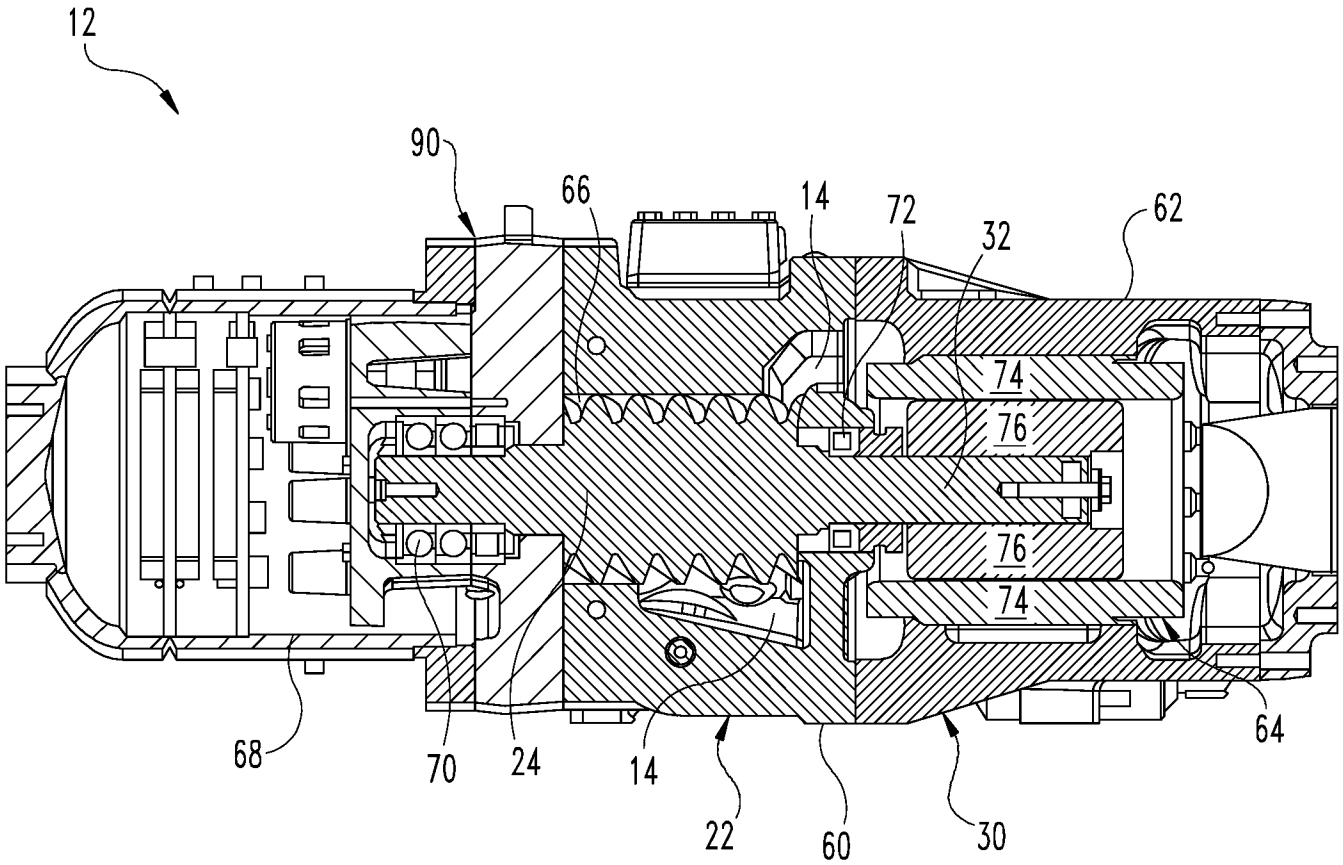
FIG. 3 is a section view of one embodiment of a compressor and motor of the compressor system of FIG. 1 along the rotation axis of the drive rotor.
Figure 4A:
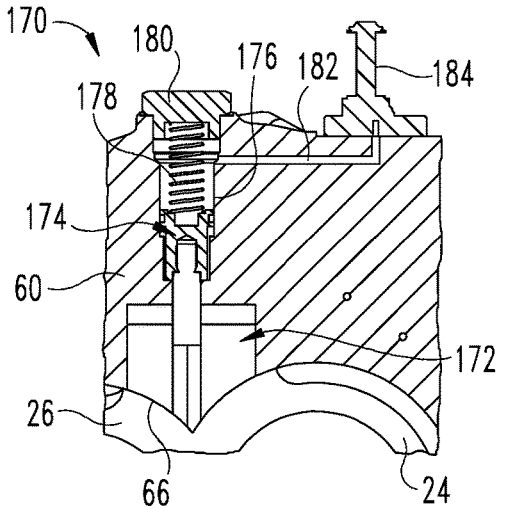
FIGS. 4A and 4B are section views of a portion of the compressor and another embodiment of a radial discharge port volume control assembly in a first position.
Figure 5A:
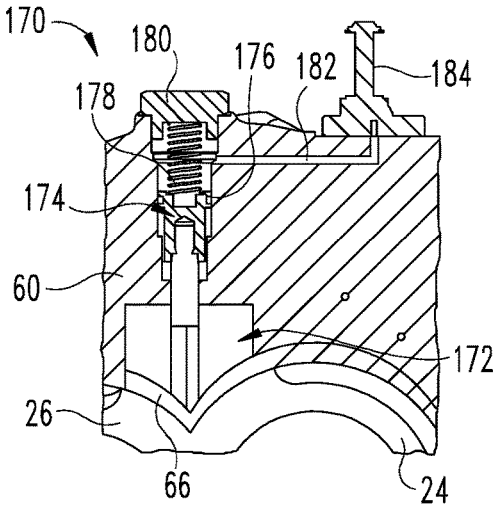
FIGS. 5A and 5B correspond to FIGS. 4A and 4B respectively and show the radial discharge port volume control assembly in a second position.
Figure 4B:
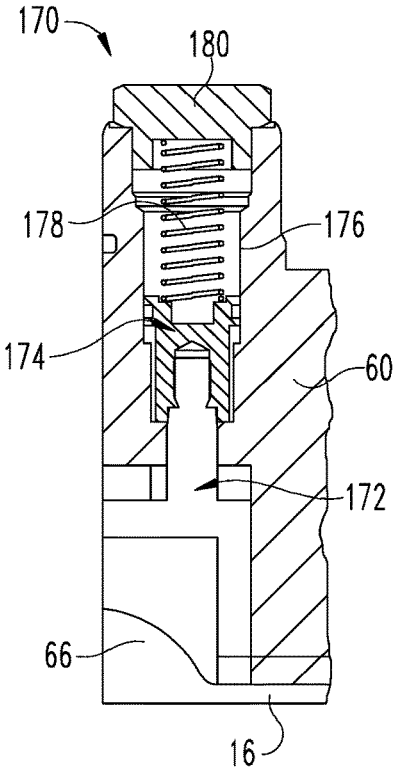
Figure 5B:
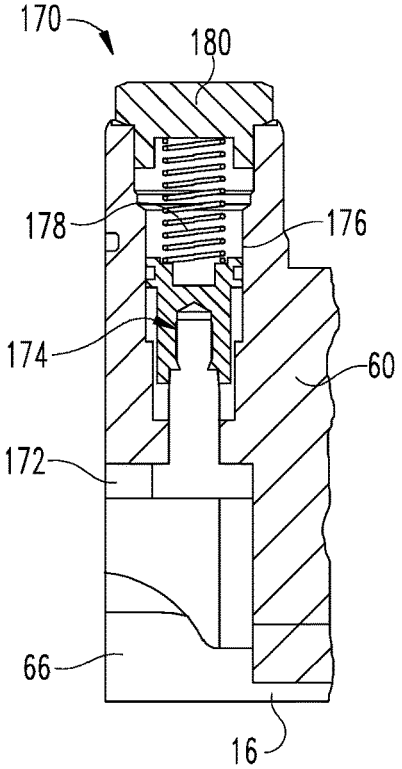
Figure 6:
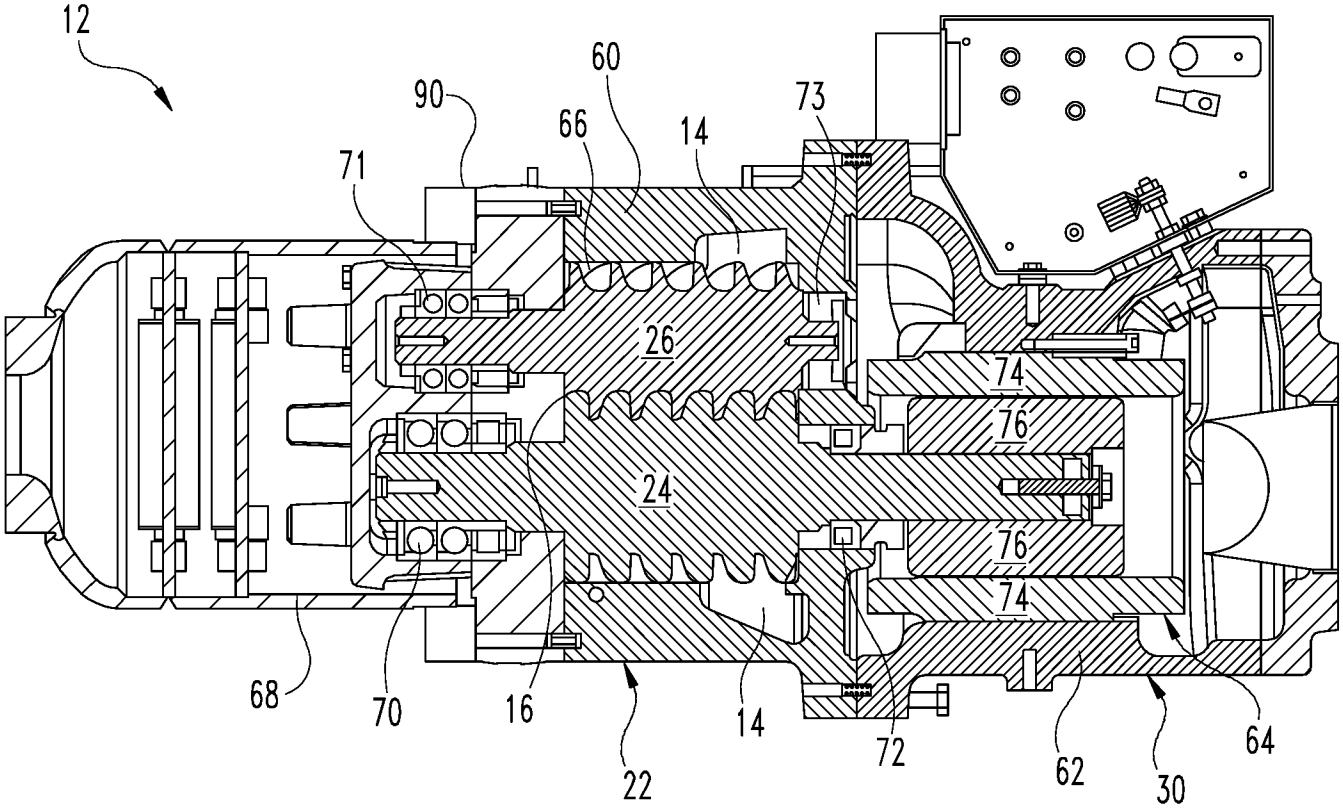
FIG. 6 is a longitudinal section view of the compressor and motor of FIG. 1 along the rotation axis of the drive rotor looking orthogonally to the section view of FIG. 3.

Referring to FIG. 2, further details of one embodiment of the refrigeration system 10 are shown. The refrigeration system 10 may include a controller 50 and a memory 51 as part of or connected to controller 50. Compressor system 12 includes an electric motor system 30 connected to a rotary compressor 22 and to a variable frequency drive 54. As shown in FIGS. 3 and 6, electric motor system 30 includes a shaft 32 that is connected to rotary compressor 22 to drive rotors 24, 26 in response to operation of motor system 30. Referring back to FIG. 2, discharge port 16 of rotary compressor 22 includes a volume control assembly, such as volume control assembly 17 or other volume control assembly embodiment discussed herein, that, as discussed further below, is operable to mechanically delay suction unloading of refrigerant from evaporator system 20 and change a capacity of compressor 22. The volume control assemblies control the volume of discharge port 16 and thus control the volume ratio of rotary compressor 22 by varying the ratio of the volume of trapped refrigerant gas by rotors 24, 26 at intake port 14 to the volume of trapped refrigerant gas by rotors 24, 26 at discharge port 16.

The compressor system 12 may further include one or more sensors 31 associated with motor system 30 that transmit signals to controller 50 via communications link 34. Compressor system 12 may also include one or more sensors 33 associated with compressor 22 that transmit signals to controller 50 via communications link 35. Compressor system 12 may also include suction pressure and/or temperature sensors 25, and discharge pressure and/or temperature sensors 27, associated with compressor 22 that transmit signals to controller 50 via communications links 28 and 29, respectively. Condenser system 18 may also include one or more sensors 36 that transmit signals to controller 50 via communications link 37, and evaporator system 20 may also include one or more sensors 38 that transmit signals to controller 50 via communications link 39. The sensors 25, 27, 31, 33, 36, 38 for example, may be employed to sense and/or communicate torque, speed, suction pressure and/or temperature, discharge pressure and/or temperature, and/or other measurable parameters. Other sensors could be employed depending on the application in which compressor system 12 is used. Furthermore, the sensors 25, 27, 31, 33, 36, 38 can be connected to controller 50 via a wired connection, wireless connection, and combinations thereof. In addition, any one or all of sensors 25, 27, 31, 33, 36, 38 can be virtual sensors.

As shown, the motor sensor 31 may be positioned proximate the electric motor system 30 to sense torque applied by the electric motor system 30 to the rotary compressor 22. Motor sensor 31 may sense electrical operating characteristics of the motor system 30. In one embodiment, the motor sensor 31 includes one or more current sensors. The current sensors may be positioned to sense the electric current supplied to the motor system 30 and may generate operational signals that are indicative of the sensed electric current. In one embodiment, the torque produced by the motor system 30 is dependent upon the electric current provided to an electric motor 64 (FIGS. 3 and 6) of motor system 30. While the motor sensor 31 in one embodiment comprises current sensors that sense current supplied to the electric motor 64, the motor sensor 31 may sense other electrical operating characteristics of the electric motor such as voltages, currents, phase angles, frequencies, effective impedances at the input and/or other parts of the electric motor and provide operational signals indicative of the sensed electrical operating characteristics.

The compressor sensor 33 may further provide operational signals with measurements that are indicative of the sensed operating parameters of rotary compressor 22, such as the tip speed of one or both of the rotors 24, 26. In addition, the suction pressure and/or temperature sensor 25 are positioned proximate the suction port 14 of the rotary compressor 22 to sense pressure and/or temperature of the fluid entering the suction port 14. Likewise, the discharge pressure and/or temperature sensor 27 may be positioned proximate the discharge port 16 of the rotary compressor 22 to sense pressure and/or temperature of the fluid discharged from the discharge port 16. The suction pressure and/or temperature sensors 25, 27 provide operational signals with measurements that are indicative of the sensed pressure and/or temperature of the fluid entering the suction port 14 and the discharge port 16, respectively. As discussed further below, the volume ratio of rotary compressor 22 can be controlled in response to one or more pressure and temperature readings from sensors 25, 27.

The controller 50 may receive status signals from one or more sensors 25, 27, 31, 33, 36, 38 that provide information regarding operation of the refrigeration system 10 and/or compressor system 12. Based upon the status signals, the controller 50 may determine an operating mode and/or operating point of the compressor system 12 and may generate, based upon the determined operating mode and/or operating point, one or more command signals 52, 58 to adjust the operation of the compressor system 12. For example, controller 50 may generate command signals 52 that request the motor system 30 to operate according to a preselected operating parameter(s) (e.g. a torque profile). The command signals 52 may enable operation at an optimal torque and speed of compressor system 12 to minimize losses and mechanical wear. Also, the command signals 52 may enable operation of motor 64 at variable torque and speed of compressor system 12 that corresponds to the load on refrigeration system 10. In addition, the controller 50 may generate command signals 58 that enable operation of rotary compressor 22 at an optimal volume ratio of compressor system 12 to minimize losses and increase efficiency.

The controller 50 may include processors, microcontrollers, analog circuitry, digital circuitry, firmware, and/or software that cooperate to control operation of the motor system 30 and the rotary compressor 22. The memory 51 may be a part of controller 50 or a separate device, and comprise non-volatile memory devices such as flash memory devices, read only memory (ROM) devices, electrically erasable/programmable ROM devices, and/or battery backed random access memory (RAM) devices to store algorithms, operating limits, and other programming and data for the operation of motor system 30 and rotary compressor 22. The memory 51 may further include instructions which the controller 50 may execute in order to control the operation of motor system 30 and the volume control assembly 17 of rotary compressor 22.

Some aspects of the described systems and techniques may be implemented in hardware, firmware, software, or any combination thereof. Some aspects of the described systems may also be implemented as instructions stored on a machine readable medium which may be read and executed by one or more processors. A machine readable medium may include any storage device to which information may be stored in a form readable by a machine (e.g., a computing device). For example, a machine readable medium may include read only memory (ROM); random access memory (RAM); magnetic disk storage media; optical storage media; flash memory devices; and others.

Controller 50 may be arranged to communicate with a variable frequency drive 54, compressor system 12, condenser system 18, and/or evaporator system 20. Variable speed drive 54 may drive the electric motor 64 of motor system 30 and in turn, drive rotary compressor 22. The speed of the electric motor 64 can be controlled by varying, for example, the frequency of the electric power that is supplied to the electric motor 64. Use of a motor system 30 with an electric motor 64 of the permanent magnet type in conjunction with variable speed drive 54 moves some conventional motor losses outside of the refrigerant loop. The variable speed drive 54 drives the compressor system 12 at the optimum, or near optimum, rotational speed at each capacity over the preselected screw compressor capacity range for a compressor system 12 of a given rated capacity. The variable speed drive 54 typically will comprise an electrical power converter comprising a line rectifier and line electrical current harmonic reducer, power circuits and control circuits (such circuits further comprising all communication and control logic, including electronic power switching circuits). Conditions in which the compressor system 12 is employed may justify employing more than one variable speed drive 54.

The variable speed drive 54 can be configured to receive command signals 52 from controller 50 and to generate a control signal 56. The variable speed drive 54 will respond, for example, to command signals 52 received from a microprocessor (also not shown) associated with controller 50 to increase or decrease the speed of the electric motor 64 of motor system 30 by changing the frequency of the current supplied to the electric motor 64. Controller 50 may be configured to receive status signals indicative of an operating point of the compressor system 12, and to generate command signals 52 that request the motor 30 to drive the rotary compressor 22 per a preselected operating parameter. Controller 50 may generate command signals 52 per a preselected operating parameter, like a torque profile for compressor system 12. Control signal 56 can drive the electric motor 64 at a rotational speed substantially greater than a synchronous motor rotational speed for the rated screw compressor capacity and drive the electric motor 64, and in turn at least one screw rotor 24, at an optimum peripheral velocity that is independent of the rated screw compressor capacity.

By the use of a motor 64 and variable speed drive 54, the speed of electric motor 64 can be varied to match varying system requirements. Speed matching results in a significantly more efficient system operation compared to a compressor system without a variable speed drive 54. By running compressor system 12 at lower speeds when the load is not high or at its maximum, sufficient refrigeration effect can be provided to cool the reduced heat load in a manner which saves energy, making the refrigeration system 10 more economical from a cost-to-run standpoint, and facilitates highly efficient refrigeration system 10 operation as compared to systems which are incapable of such load matching at the rotational speeds possible. Furthermore, as discussed below, the ability to match the speed of motor 64 in response to load conditions created by changing the volume ratio of rotary compressor 22 further increases efficiency.

The motor system 30 and the variable speed drive 54 have power electronics for low voltage (less than about 600 volts), 50 Hz and 60 Hz applications. Typically, an AC power source (not shown) will supply multiphase voltage and frequency to the variable speed drive 54. The AC voltage or line voltage delivered to the variable speed drive 38 will typically have nominal values of 200V, 230V, 380V, 415V, 480V, or 600V at a line frequency of 50 Hz or 60 Hz depending on the AC power source.

Referring now to FIGS. 3 and 6, rotary compressor 22 is shown as a screw compressor that includes a plurality of meshed screw type rotors 24, 26. The meshed screw rotors 24, 26 define one or more compression pockets between the rotors 24, 26 and interior chamber walls defining a working chamber 66 of the housing 60 of rotary compressor 22. The torque supplied by the motor system 30 rotates the screw rotors 24, 26, thus closing the compression pocket from the suction port 14. Rotation of the rotors 24, 26 further decreases the volume of the compression pocket as the rotors 24, 26 move the fluid toward the discharge port 16. Due to decreasing the volume of the compression pocket, the rotors 24, 26 deliver the fluid to the discharge port 16 at a discharge pressure that is greater than the suction pressure and at a discharge temperature that is greater than the suction temperature.

Compressor system 12 further includes an electric motor housing 62 mounted to compressor housing 60 adjacent intake port 14. Motor housing 62 houses electric motor 64 that is coupled to variable frequency drive 54. The electric motor 64 is operable to drive meshed screw rotors 24, 26. In another embodiment, motor housing 62 is integral to the compressor housing 60. The compressor housing 60 may have a low pressure end with suction port 14 and a high pressure end with a discharge port 16. Suction port 14 and discharge port 16 are in open-flow communication with the working chamber 66 defined by compressor housing 60. The suction port 14 and the discharge port 16 may each be an axial, a radial or a mixed combination of a radial and an axial port to receive and discharge refrigerant fluid.

Suction port 14 and discharge port 16 are configured to minimize flow losses, when at least one of the rotors 24, 26 is operated at an approximately constant peripheral velocity. The suction port 14 may be located where refrigerant is drawn into the working chamber 66. The suction port 14 may be sized to be as large as possible to minimize, at least, the approach velocity of the refrigerant and the location of the suction port 14 may also be configured to minimize turbulence of refrigerant prior to entry into the rotors 24, 26. Discharge port 16 may be sized larger than theoretically necessary to provide a thermodynamic optimum size and thereby, reduce the velocity at which the refrigerant exits the working chamber 66. The discharge port 16 may be generally located where refrigerant exits the working chamber 66 of rotary compressor 22. The discharge port 16 location in the compressor housing 60 may be nominally configured such that the maximum discharge pressure can be attained in the rotors 24, 26 prior to being delivered into the discharge port 16. In addition, rotary compressor 22 may incorporate a muffler 68 or other apparatus suitable for noise reduction. Muffler 68 is mounted to a bearing housing 90 that houses bearing assemblies 70, 71 rotatably mounted to shafts of the respective rotors 24, 26.

Rotors 24, 26 are mounted for rotation in working chamber 66. The working chamber 66 defines a volume that is shaped as a pair of parallel, longitudinally intersecting cylinders with flat ends, and is closely toleranced to the exterior dimensions and geometry of the intermeshed screw rotors 24, 26 to define one or more compression pockets between the screw rotors 24, 26 and the interior chamber walls of the compressor housing 60. First rotor 24 and second rotor 26 are disposed in a counter-rotating, intermeshed relationship and cooperate to compress a fluid. First rotor 24 is operably coupled to motor 64 to be rotated at a rotational speed for a screw compressor capacity within a preselected screw compressor capacity range. In one embodiment, the selected rotational speed at full-load capacity is substantially greater than a synchronous motor rotational speed at a rated capacity (also referred to herein as rated screw compressor capacity) for compressor system 12.

In the illustrated embodiment, first rotor 24 may be called a male screw rotor and comprise a male lobed/fluted body or working portion, typically a helically or spirally extending land and groove. Second rotor 26 may be called a female screw rotor and comprises a female lobed/fluted body or working portion, typically a helically or spirally extending land and groove. In other embodiments, first rotor 24 is a female rotor and second rotor 26 is a male rotor. Rotors 24, 26 each include a shaft portion, which is, in turn, mounted to the compressor housing 60. For example, one or more bearing assemblies 70, 72 mount the ends of rotor 24 to bearing housing 90 and compressor housing 60, respectively. Bearing assemblies 71, 73 mount the ends of rotor 26 to bearing housing 90 and to compressor housing 60, respectively.

The electric motor 64 in one exemplary embodiment may drive at least one of the rotors 24, 26 in response to command signals 52 received from the controller 50. The horsepower of motor 64 can vary, for example, in the range of about 125 horsepower to about 2500 horsepower. Torque supplied by the electric motor 64 may directly rotate at least one of the screw rotors 24, 26, such as first rotor 24 in the illustrated embodiment. Employing motor 64 and variable speed drive 54, compressor system 12 of embodiments of the present invention may have a rated screw compressor capacity within the range of about 35-tons to about 500-tons or more.

While conventional types of motors, like induction motors, can be used with and will provide a benefit when employed with embodiments disclosed herein, in a specific embodiment electric motor 64 comprises a direct drive, variable speed, hermetic, permanent magnet motor. A motor 64 of the permanent magnet type can increase system efficiencies over other motor types. The permanent magnet embodiment of motor 64 comprises a motor stator 74 and a motor rotor 76. Stator 74 includes wire coils formed around laminated steel poles, which convert variable speed drive 54 applied currents into a rotating magnetic field. The stator 74 is mounted in a fixed position in the compressor system 12 and surrounds the motor rotor 76, enveloping the rotor 76 with the rotating magnetic field. Motor rotor 76 is the rotating component of the motor 64 and may include a steel structure with permanent magnets, which provides a magnetic field that interacts with the rotating stator magnetic field to produce rotor torque. In addition, motor 64 may be configured to receive variable frequency control signals and to drive the at least two screw rotors per the received variable frequency control signals. Cooling of motor 64 can be provided from the fluid circulated through refrigeration system 10.

In addition to providing capacity control of compressor system 12 by connecting electric motor 64 with variable speed drive 54, compressor system 12 includes a volume control assembly 17, 170. Volume control assemblies 17, 170 regulate the volume ratio (Vi) of compressor 22 based on operating conditions of refrigeration system 10 while motor 64 operates compressor 22 at a compressor speed via variable frequency drive 54 that corresponds to the load on refrigeration system 10. In one embodiment, variable volume control assembly 17, 170 is operable to control the volume ratio of compressor 22 based on the saturated suction temperature and the saturated discharge temperature to provide maximum efficiency while the speed of compressor 22 is controlled according to the load on refrigeration system 10. Changing the volume ratio to match operating conditions such as the saturated pressure of condenser system 18 can prevent compressed refrigerant gas from being either under or over-compressed, both of which result in unnecessary extra work. Variable frequency drive 54 controls motor 64 in response to controller 50 to match the capacity of compressor 22 to the load and optimize efficiency.

The volume ratio of rotary compressor 22 is determined by the volume of refrigerant gas trapped at suction port 14 to the volume of refrigerant gas trapped prior to release to discharge port 16. Thus, adjusting the timing of the opening of the compression pocket of rotors 24, 26 storing refrigerant at discharge port 16 prior to release results in changing of the volume ratio of rotary compressor 22. In operation, the outlet pressure of evaporator system 20 determines the pressure of refrigerant at suction port 14 and, assuming a constant compressor volume, the design of rotors 24, 26 and geometry of working chamber 66 determines the pressure of the refrigerant at discharge port 16 as a function of the suction pressure. If the operating pressure of condenser system 18 is lower than the discharge pressure at discharge port 16, then the refrigerant is over-compressed and compressor system 12 has worked more than necessary. If the operating pressure of condensing system 18 is more than the discharge pressure at discharge port 16 of compressor 22, then refrigerant backflows from the discharge port 16 into the last compression pocket of rotors 24, 26, creating additional work for compressor system 12 due to re-compression and displacement of already compressed refrigerant and the heating of refrigerant in compressor 22. Volume control assembly 17, 170 is operable to adjust the volume of compressed refrigerant at discharge port 16 and thus the volume ratio of compressor 22 to match operating conditions of condenser system 18 and avoid unnecessary work by compressor system 12, improving system efficiency.

Referring now to FIGS. 4A-5B, one embodiment of a volume control assembly is shown and designated as volume control assembly 170. Volume control assembly 170 includes a volume control member that is movable transversely to the rotational axis of rotors 24, 26 to adjust the radial discharge port volume. In the illustrated embodiment, the volume control member includes a radially movable valve member 172 at discharge port 16 that moves radially, i.e. transversely to the axis of rotation of rotors 24, 26, inwardly and outwardly between a first position shown in FIGS. 4A-4B and a second position shown in FIGS. 5A-5B with an actuating mechanism. In the illustrated embodiment, the actuating mechanism includes a piston 174 and biasing member 178 housed in a chamber 176 of compressor housing 60 that is in fluid communication with working chamber 66 of compressor housing 60.

Volume control assembly 170 includes valve 172 connected to piston 174 that is movably housed in chamber 176 of compressor housing 160 adjacent to discharge port 16. In the first position of FIGS. 4A-4B, valve 172 is located in working chamber 66 between rotors 24, 26 and in close proximity to the discharge ends of rotors 24, 26 to close a radial portion of discharge port 16 along rotors 24, 26. The first position provides an increased volume ratio for compressor 22. In the second position of FIGS. 5A-5B, valve 172 is retracted toward housing 60 to provide additional radial volume along the discharge ends of rotors 24, 26 to increase the discharge port volume and lower the volume ratio of compressor 22. Valve 172 can be either opened, closed, or pulsed to affect the volume ratio between the opened and closed positions.

Valve 172 can be connected to piston 174 by a threaded connection, a friction fit, welded connection, or other suitable connection. A biasing member 178, such as a coil spring in the illustrated embodiment, can be positioned between an end cap 180 that closed chamber 176 and piston 174 to assist in moving valve 172 between the first and second positions. Valve 172 is held in the first position by a combination of force from biasing member 178 and refrigerant gas at the discharge pressure that is inlet into chamber 176 through a port 182. Port 182 is connected to a solenoid valve 184 that selectively isolates and opens first and second channels of port 182 that are connected to working chamber 66 at respective ones of the discharge port 16 and suction port 14.

When the operating conditions of refrigeration system 10 change such that lower saturated discharge temperatures result, which corresponds to a lower condenser system pressure, the efficiency of compressor system 12 can be improved by moving valve 172 from the first position to the second position, which decreases the volume ratio of compressor 22. In one embodiment, controller 50 receives inputs of discharge pressure from sensor 27 and/or the saturated discharge temperature of condenser system 18 from sensor 36 which corresponds to a condenser operating pressure. When the saturated discharge temperature falls below a predetermined threshold, a command signal to solenoid valve 184 either actuates or de-actuates solenoid valve to isolate port 182 from the discharge pressure and allow port 182 to receive refrigerant gas at the suction pressure. The lower suction pressure acting on piston 174 allows the higher discharge pressure acting on valve 172 to displace valve 172 against biasing member 178 to the second position of FIGS. 5A-5B. In one embodiment, the predetermined threshold saturated discharge temperature is between 90 and 120 degrees F. with R134a refrigerant. In one specific embodiment, the temperature is about 110 degrees F. Other embodiments contemplate other threshold temperatures and temperature ranges depending on the system design and operating parameters.

When the saturated discharge temperature exceeds the predetermined threshold temperature, then the solenoid valve 184 operates in reverse to isolate the refrigerant gas from the suction end of working chamber 66 from port 182 and admit gas from the discharge port 16 of working chamber 66. The higher pressure gas works with biasing member 178 to move valve 172 from the second position to the first position of FIGS. 4A-4B.

Figure 7:
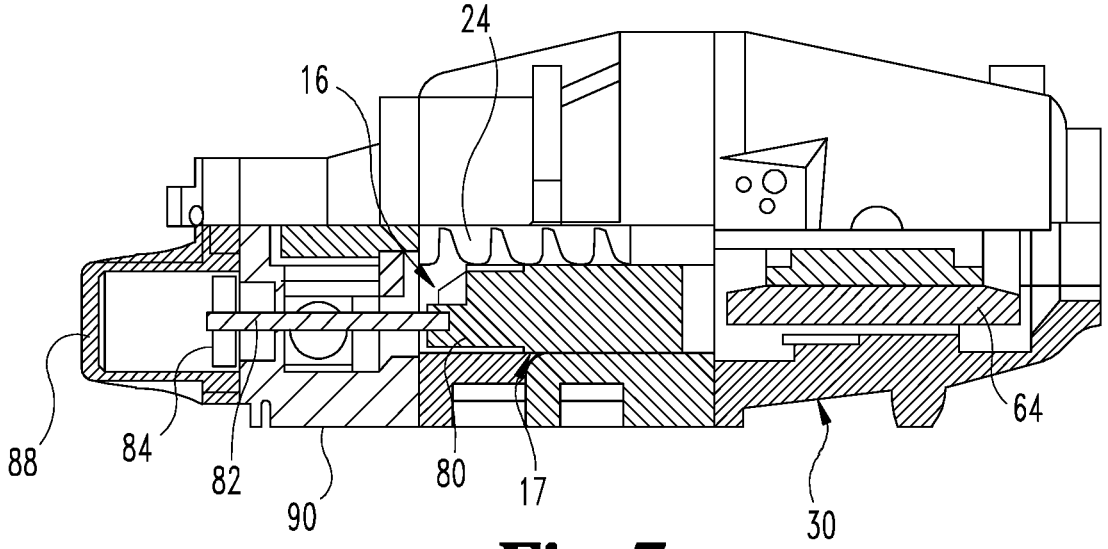
FIG. 7 is a partial section, longitudinal view of the compressor and rotor showing a radial discharge port volume control assembly with a slide valve in a first position.
Figure 8:
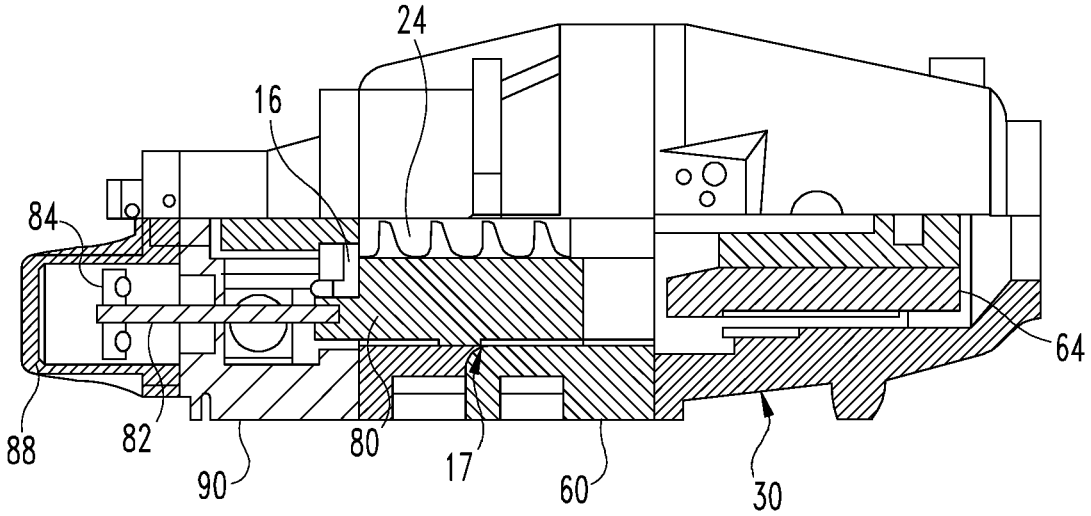
FIG. 8 is a partial section, longitudinal view of the compressor and rotor showing the radial discharge port volume control assembly of FIG. 7 with the slide valve in a second position.
Figure 9:
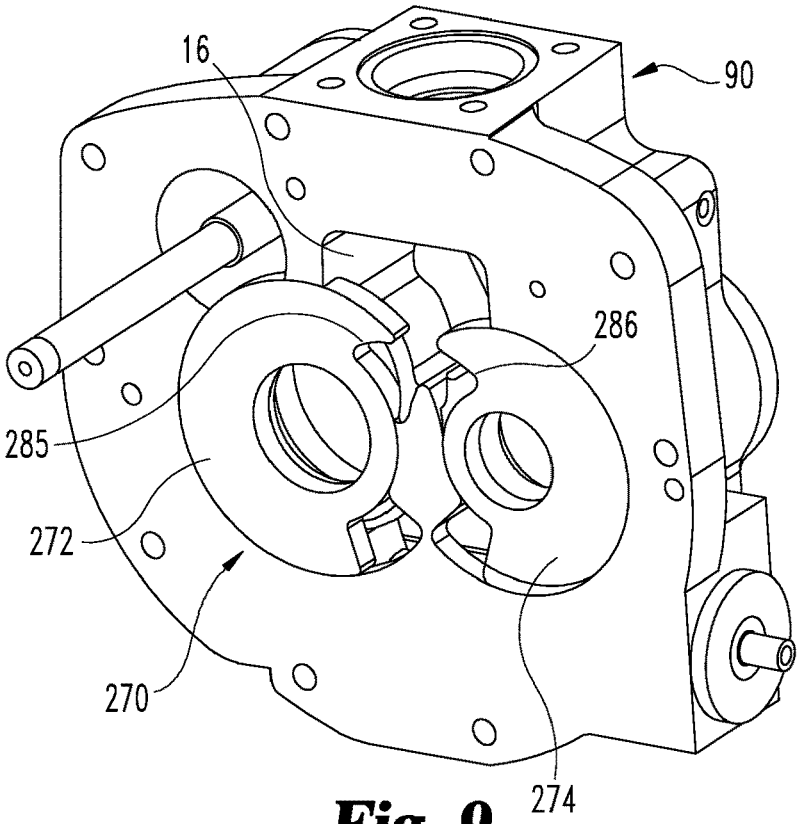
FIG. 9 is a perspective view of a portion of the compressor housing looking from the motor housing toward the discharge end of the compressor housing showing an axial volume discharge port control assembly in a first position.
Figure 10:
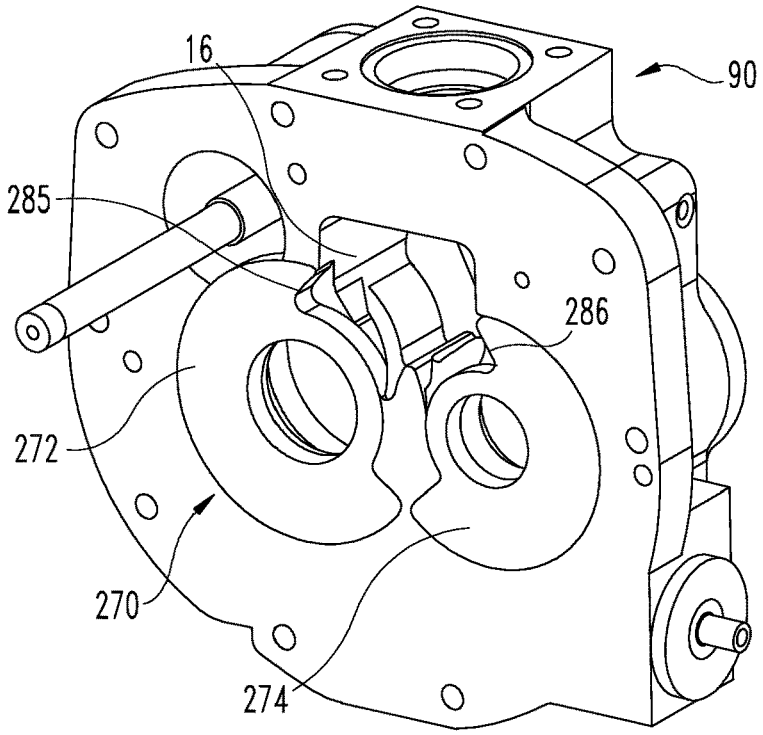
FIG. 10 is the view of FIG. 9 showing the axial volume discharge port control assembly in a second position.

FIGS. 7 and 8 show another embodiment of a volume control assembly designated as volume control assembly 17. Volume control assembly 17 includes a volume control member such as a slide valve 80 that is movable axially in a direction paralleling the rotation axis of rotors 24, 26 along the outer periphery of rotors 24, 26 between a first position shown in FIG. 7 and a second position shown in FIG. 8. Slide valve 80 is positionable to control the radial discharge volume of rotors 24, 26 at discharge port 16. In FIG. 7, slide valve 80 is positioned to provide a radial discharge port volume that extends along one or more the flutes of rotors 24, 26, resulting in a low volume ratio. To reduce the radial discharge port volume and thus increase the volume ratio, slide valve 80 can be moved to the position of FIG. 8. Increasing the volume ratio of compressor 12 increases the length of time and distance that refrigerant is compressed by rotors 24, 26 and decreases the volume of the closed compression pocket prior to being released into the discharge port 16, thus increasing the discharge pressure at discharge port 16. It is contemplated that slide valve 80 can be continuously variably displaced between the positions of FIGS. 7 and 8 to vary the pocket volume at discharge port 16 in response to the condenser system operating pressure. In one embodiment, slide valve 80 is connected to a shaft 82 that extends axially to a piston 84 in a piston housing 88. Refrigerant gas pressure can be delivered to piston housing 88 in a controlled manner to selectively move slide valve 80 to the desired position.

Referring now to FIGS. 9-13, an embodiment of a volume control assembly is provided and designated as volume control assembly 270. Volume control assembly 270 includes a pair of volume control members that are rotatable about axes that are parallel to the rotational axis of rotors 24, 26 that are operable to control the axial discharge port volume of rotors 24, 26 to selectively adjust the timing that various compression pockets on the discharge ends of rotors 24, 26 open and close and control the timing of refrigerant discharge, thus varying the volume ratio of compressor 22. Volume control assembly 270 can be used as the sole volume control assembly, or combined with one of the radial volume control assemblies 17, 170 discussed herein.

Volume control assembly 270 includes, in the illustrated embodiment, volume control members in the form of first and second rotatably adjustable discharge end plates 272, 274 that reside in respective ones of the pockets 276, 278 defined by bearing housing 90. Endplates 272, 274 are rotatable about the axis of the respective rotor 24, 26 from a first position shown in FIG. 9 to a second position shown in FIG. 10 with an actuating mechanism. In the illustrated embodiment, the actuating mechanism includes a shaft 280 coupled to end plates 272, 274 such that rotation of the shaft 280 rotates end plates 272, 274. In the first position of FIG. 9, end plates 272, 274 are positioned to maximize the volume ratio by increasing the time before discharge of refrigerant from rotors 24, 26, thus reducing the axial discharge port volume of discharge port 16. In the second position of FIG. 10, end plates 272, 274 are positioned to minimize the volume ratio by decreasing the time the refrigerant is compressed by rotors 24, 26, thus increasing the axial discharge port volume of discharge port 16.

Figure 11:
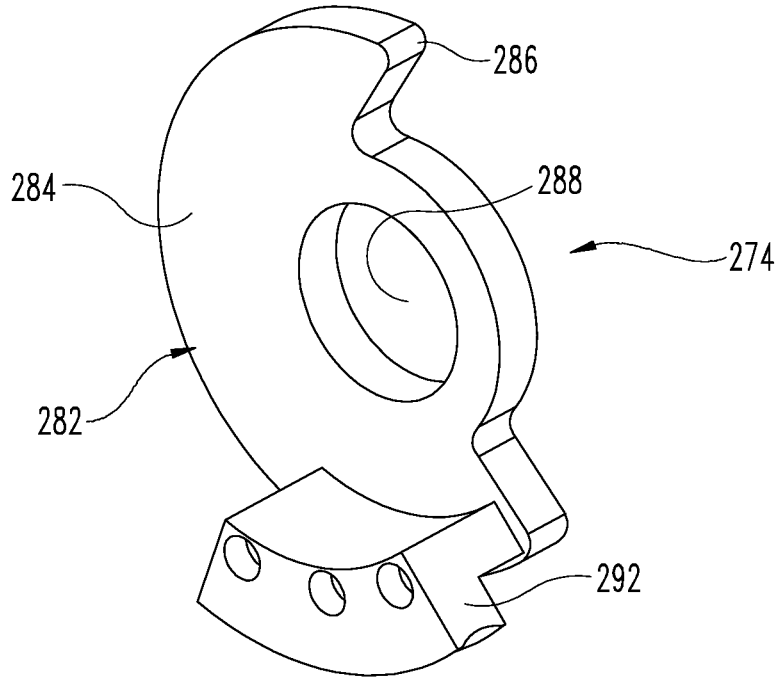
FIG. 11 is a perspective view of an end plate of the discharge port control assembly of FIGS. 9 and 10.

FIG. 11 shows an example of end plate 274, it being understood that end plate 272 is similarly configured but sized to cooperate with rotor 24. End plate 274 includes a plate-like body 282 having a semi-circular portion 284 extending to a notched region 286. Body 282 also defines a through-hole 288 to receive the shaft of rotor 26 therethrough. Notched region 286 is defined by an undercut that extends radially and circumferentially inwardly from the outer perimeter of semi-circular portion 284. The notched region 285 of end plate 272, and a similar notched region 286 of end plate 274, are shaped to match the end contour of the screw lobe of the respective rotor 24, 26. The rotational position of notched regions 285, 286 relative to the respective rotor 24, 26 determines the point at which a trapped compression pocket of refrigerant begins to discharge through discharge port 16.

Figure 12:
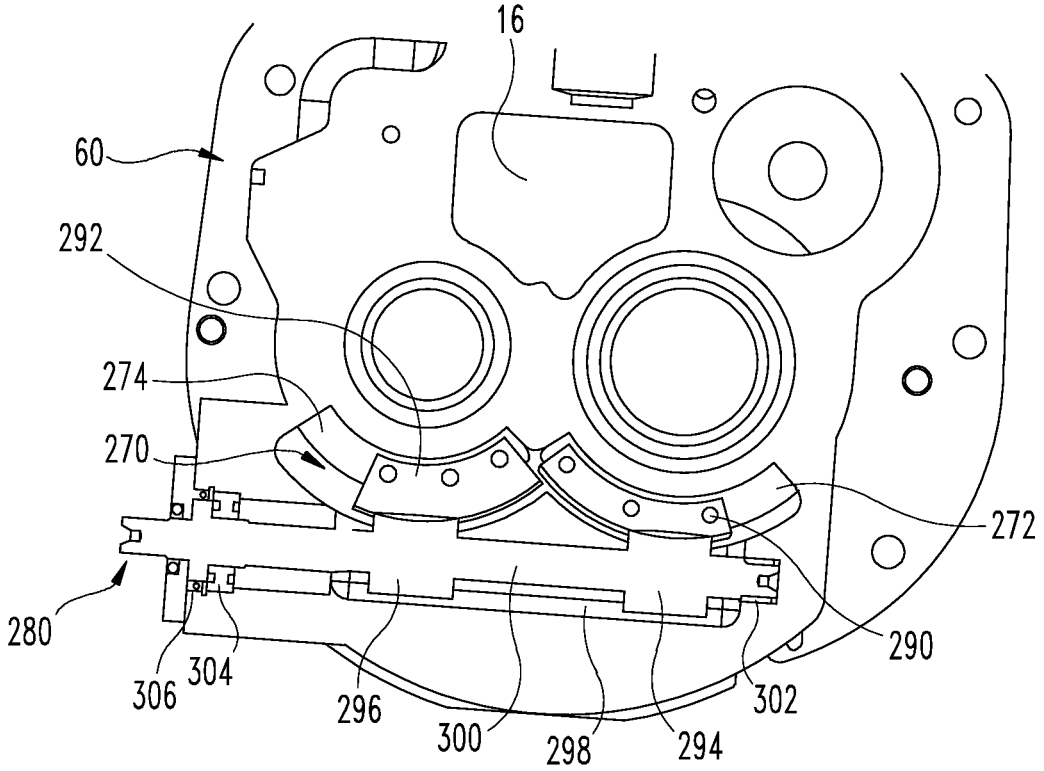
FIG. 12 is an elevation view of the discharge end of the compressor housing looking toward the motor housing.

End plates 272, 274 also each include an attachment member 290, 292 that are engaged with respective ones of the engaging members 294, 296 of shaft 280. As shown in FIG. 12, shaft 280 includes an elongated body 300 extending through a passage 298 in bearing housing 90. Shaft 280 is rotatably supported with bearing assemblies 302, 304 at opposite ends of elongate body 300 that allow rotation of shaft 280 about its longitudinal axis. A pressure-actuated seal 306 can be provided to seal bearing assembly 304 with bearing housing 90. Attachment members 290, 292 are engaged by the respective engaging members 294, 296 of shaft 280 so that rotation of shaft 280 rotates end plates 272, 274 between the first and second positions of FIGS. 9 and 10. In one embodiment, shaft 280 is a worm gear that engages gear-like attachment members 290, 292 to rotate end plates 272, 274. In a further embodiment, shaft 280 is driven by a stepper motor connected to controller 50 and an encoder that provides an indication of the position of end plates 272, 274 to controller 50.

Figure 13:
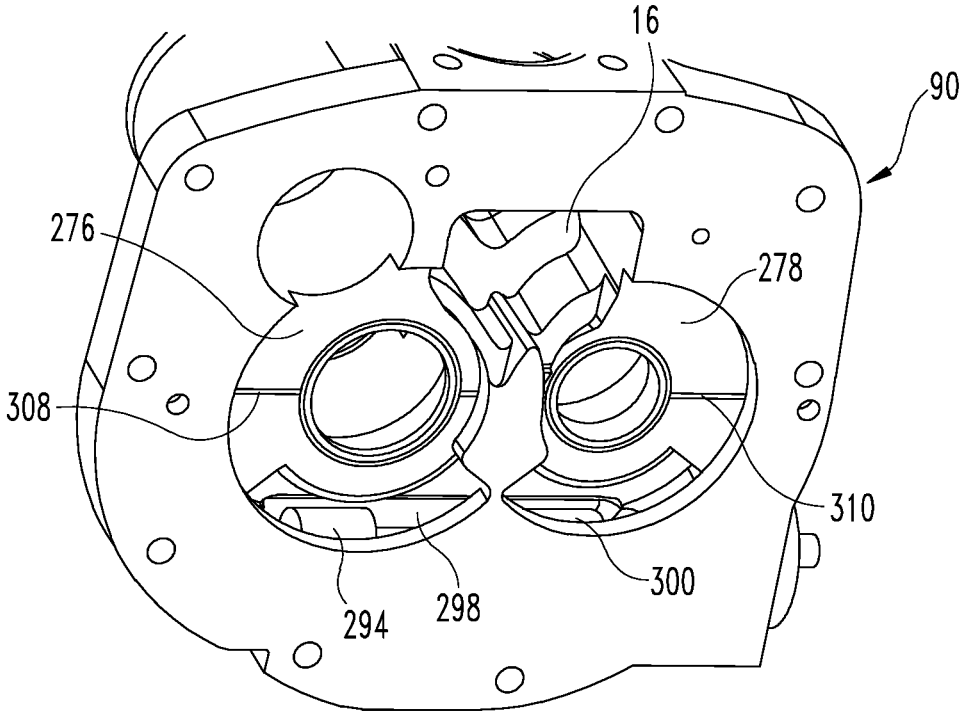
FIG. 13 is a perspective view of the portion of the compressor housing looking from the motor housing toward the discharge end of the compressor housing with the control members of the axial discharge port volume control assembly removed.

As shown in FIG. 13, pockets 276, 278 can each include a floating face seal 308, 310 positioned in grooves formed in bearing housing 90 to minimize leakage of refrigerant around end plates 272, 274. Seals 308, 310 allow end plates 272, 274 to rotate while creating high pressure regions behind end plates 272, 274 that bias end plates 272, 274 toward compressor housing 60, facilitating sealing of the axial discharge ports of rotors 24, 26 by the respective end plate 272, 274. To prevent endplates 272, 274 from contacting the ends of rotors 24, 26, the peripheral dimension defined by the semi-circular portions of the end plates 272, 274 is larger than the bore defined by housing 60 for the respective rotor 24, 26 so that end plates 272, 274 abut the compressor housing 60.

Control of the axial discharge volume with volume control assembly 270 can be accomplished by feedback control or feed forward control. For example, controller 50 can monitor system suction and discharge temperatures and/or pressures and position end plates 272, 274 to provide the optimal volume ratio based on operating conditions. The position of end plates 272, 274 can be determined, for example, by a look-up table programmed in controller 50. In another embodiment, controller 50 monitors the amperage of motor 64 and adjusts end plates 272, 274 to tune the volume ratio until a minimum power is observed.

In addition to providing variable speed operation of motor 64 and adjustable volume control of discharge port 16 to increase efficiency, compressor system 12 can be operated at rotational speeds substantially higher than synchronous motor rotational speeds for a given rated capacity of the compressor 22. The specific optimum speed for the rated screw compressor capacity range is a function of screw compressor capacity and head pressure. The allowable range of rotational speed for a particular rated capacity of compressor 22 is selected to achieve an optimum peripheral velocity of at least one of the screw rotors independent of the rated capacity of screw compressor 12. The optimum peripheral velocity is a constant product of the rotational speed and the radius of at least one of the rotors 24, 26, typically, the male rotor 24.

The rotational speed of the motor 64 may be selected in combination with configuring rotors 24, 26, suction port 14 and discharge port 16 for each target capacity to achieve an approximately constant optimum peripheral velocity of at least one of the screw rotors 24, 26 regardless of the rated capacity of the screw compressor 12. The specific combinations of screw rotors 24, 26, suction port 14, discharge port 16 and the operational rotational speed are selected such that each specific combination enables compressor 22 to run at an optimum peripheral velocity for the rated capacity. Further details of optimal peripheral velocity control are disclosed in U.S. Patent App. Pub. No. 2012/0017634 published on Jan. 26, 2012, which is incorporated herein by reference in its entirety for all purposes.

In one embodiment, a method for operating a refrigeration system includes receiving operational signals relating to operating pressures of the refrigeration system and a load on the refrigeration system, operating a mechanical delayed suction type compressor unloader in response to the load on the refrigeration system, and adjusting a volume ratio of the compressor unloader in response to the operating pressures of the refrigeration system and a capacity of the compressor unloader.

It shall be understood that the exemplary embodiments summarized and described in detail above and illustrated in the figures are illustrative and not limiting or restrictive. Only the presently preferred embodiments have been shown and described and all changes and modifications that come within the scope of the invention are to be protected. It shall be appreciated that the embodiments and forms described below may be combined in certain instances and may be exclusive of one another in other instances. Likewise, it shall be appreciated that the embodiments and forms described below may or may not be combined with other aspects and features disclosed elsewhere herein. It should be understood that various features and aspects of the embodiments described above may not be necessary and embodiments lacking the same are also protected. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A refrigeration system, comprising:

a compressor comprising a compressor housing defining a suction port, a working chamber, and a discharge port, the compressor further comprising at least two rotors in the working chamber cooperatively arranged relative to one another to compress a fluid as the at least two rotors rotate relative to one another, the fluid being received into the working chamber through the suction port and being discharged from discharge ends of the rotors through the discharge port;

a motor assembly including a motor operable to drive at least one of the at least two rotors at a rotational speed;

a controller configured to receive operational parameters of the refrigeration system; and a volume control assembly at the discharge port of the compressor that is configured to receive a command signal from the controller and displace at least one volume control member relative to the discharge ends of the at least two rotors to vary a volume ratio of the compressor from a first condition to a second condition in response to operational parameters of the refrigeration system;

wherein the volume control assembly includes a radial discharge port volume control assembly; and wherein the volume control assembly further includes an axial discharge port volume control assembly.

2. The system of claim 1, wherein the rotational speed operates the at least one rotor at an optimum peripheral velocity that is independent of a peripheral velocity of the at least one rotor at a synchronous motor rotational speed for a rated capacity of the compressor.

3. The system of claim 1, wherein the fluid is a refrigerant.

4. The system of claim 1, wherein the motor comprises a permanent magnet motor.

5. The system of claim 1, wherein the radial discharge port volume control assembly includes a slide valve movable axially along a periphery of the first and second rotors adjacent the discharge port to vary a radial discharge volume of the rotors at the discharge port.

6. The system of claim 1, wherein the radial discharge port volume control assembly includes a valve movable radially toward and away from the first and second rotors adjacent the discharge port to vary a radial discharge volume of the rotors at the discharge port.

7. The system of claim 6, wherein the valve is connected to an actuator assembly, the actuator assembly including a piston movably positioned in a chamber defined by the compressor housing, wherein the chamber is selectively in fluid communication with the discharge port and the suction port to vary a pressure on the piston to adjust a radial position of the valve relative to the rotors.

8. The system of claim 7, further comprising a biasing member in the chamber engaged to the piston to bias the valve toward the working chamber.

9. The system of claim 1, wherein the axial discharge port volume control assembly includes a first end plate rotatably mounted at the discharge end of the first rotor and a second end plate rotatably mounted at the discharge end of the second rotor, each of the first and second end plates defining a notched region corresponding to an axial end outlet of respective ones of the first and second rotors.

10. The system of claim 9, wherein the first rotor includes a shaft extending through the first end plate and the second rotor includes a shaft extending through the second end plate.

11. The system of claim 9, wherein the first and second end plates each include an attachment member, and the axial port volume control assembly includes an elongated shaft with first and second engaging members engaged to respective ones of the attachment members, wherein rotation of the elongated shaft rotates the first and second end plates between first and second positions.

12. The system of claim 1, further comprising a variable speed drive connected to the motor, the variable speed drive being configured to receive a command signal from the controller and to generate a control signal that drives the motor at the rotational speed, wherein the variable speed drive is configured to vary the rotational speed of the motor in response to the command signal.

13. The system of claim 1, wherein the volume control member is displaced transversely to a rotational axis of at least one of the at least two rotors.

14. A refrigeration system, comprising:

a compressor comprising a compressor housing defining a suction port, a working chamber, and a discharge port, the compressor further comprising at least two rotors in the working chamber cooperatively arranged relative to one another to compress a fluid as the at least two rotors rotate relative to one another, the fluid being received into the working chamber through the suction port and being discharged from discharge ends of the rotors through the discharge port;

a motor assembly including a motor operable to drive at least one of the at least two rotors at a rotational speed;

a controller configured to receive operational parameters of the refrigeration system; and a radial discharge port volume control assembly at the discharge port of the compressor that is configured to receive a command signal from the controller and displace at least one volume control member relative to the discharge ends of the at least two rotors to vary a volume ratio of the compressor from a first condition to a second condition in response to operational parameters of the refrigeration system;

wherein the radial discharge port volume control assembly includes a slide valve movable axially along a periphery of the first and second rotors adjacent the discharge port to vary a radial discharge volume of the rotors at the discharge port.

15. The system of claim 14, further comprising a variable speed drive connected to the motor, the variable speed drive being configured to receive a command signal from the controller and to generate a control signal that drives the motor at the rotational speed, wherein the variable speed drive is configured to vary the rotational speed of the motor in response to the command signal.

16. A refrigeration system, comprising:

a compressor comprising a compressor housing defining a suction port, a working chamber, and a discharge port, the compressor further comprising at least two rotors in the working chamber cooperatively arranged relative to one another to compress a fluid as the at least two rotors rotate relative to one another, the fluid being received into the working chamber through the suction port and being discharged from discharge ends of the rotors through the discharge port;

a motor assembly including a motor operable to drive at least one of the at least two rotors at a rotational speed;

a controller configured to receive operational parameters of the refrigeration system;

an axial discharge port volume control assembly at the discharge port of the compressor that is configured to receive a command signal from the controller and displace at least one volume control member relative to the discharge ends of the at least two rotors to vary a volume ratio of the compressor from a first condition to a second condition in response to operational parameters of the refrigeration system; and a radial discharge port volume control assembly at the discharge port of the compressor that is configured to receive the command signal from the controller and displace at least one volume control member relative to the discharge ends of the at least two rotors to vary the volume ratio of the compressor from the first condition to the second condition in response to operational parameters of the refrigeration system.

17. The system of claim 16, further comprising a variable speed drive connected to the motor, the variable speed drive being configured to receive a command signal from the controller and to generate a control signal that drives the motor at the rotational speed, wherein the variable speed drive is configured to vary the rotational speed of the motor in response to the command signal.

18. The system of claim 16, wherein the radial discharge port volume control assembly includes a slide valve movable axially along a periphery of the first and second rotors adjacent the discharge port to vary a radial discharge volume of the rotors at the discharge port.

19. The system of claim 16, wherein the radial discharge port volume control assembly includes a valve movable radially toward and away from the first and second rotors adjacent the discharge port to vary a radial discharge volume of the rotors at the discharge port.

* * * * *